US007958736B2

(12) United States Patent
Banerji et al.

(10) Patent No.: US 7,958,736 B2
(45) Date of Patent: Jun. 14, 2011

(54) THERMOELECTRIC DEVICE AND HEAT SINK ASSEMBLY WITH REDUCED EDGE HEAT LOSS

(75) Inventors: Sunand Banerji, Stoneham, MA (US); Joseph N. Bretton, Boston, MA (US); Vorin Hay, Nashua, NH (US)

(73) Assignee: Bio-Rad Laboratories, Inc., Hercules, CA (US)

( * ) Notice: Subject to any disclaimer, the term of this patent is extended or adjusted under 35 U.S.C. 154(b) by 466 days.

(21) Appl. No.: 12/119,241

(22) Filed: May 12, 2008

(65) Prior Publication Data

US 2008/0314557 A1 Dec. 25, 2008

Related U.S. Application Data

(60) Provisional application No. 60/931,846, filed on May 24, 2007.

(51) Int. Cl.
*F25B 21/02* (2006.01)

(52) U.S. Cl. ..... 62/3.2; 62/3.7

(58) Field of Classification Search ..... 62/3.2, 62/3.3, 3.7; 165/80.3
See application file for complete search history.

(56) References Cited

U.S. PATENT DOCUMENTS

| | | | | |
|---|---|---|---|---|
| 6,345,507 | B1 * | 2/2002 | Gillen | 62/3.7 |
| 6,430,934 | B2 * | 8/2002 | Evans et al. | 62/3.2 |
| 6,499,306 | B2 * | 12/2002 | Gillen | 62/129 |
| 7,051,536 | B1 | 5/2006 | Cohen et al. | |
| 2005/0242303 | A1 | 11/2005 | Platzgummer | |

* cited by examiner

*Primary Examiner* — Melvin Jones
(74) *Attorney, Agent, or Firm* — Kilpatrick Townsend & Stockton LLP.; M. Henry Heines

(57) ABSTRACT

An assembly that includes one or more thermoelectric devices and a heat sink and that corrects the problem of an uneven heating effect across the area occupied by the devices due to a lateral heat loss at the edges of the devices or other anomalies among the devices is constructed with a heat sink that contains voids in the slab or flat surface that is in thermal contact with the thermoelectric devices. The voids are located at or within the periphery of the area that is directly aligned with the thermoelectric devices and are concentrated in regions relatively close to the periphery, leaving an area in the center of the slab that is either void-free or of a relatively low void density.

13 Claims, 4 Drawing Sheets

THERMOELECTRIC DEVICE AND HEAT SINK ASSEMBLY WITH REDUCED EDGE HEAT LOSS

CROSS-REFERENCE TO RELATED APPLICATIONS

This application claims the benefit of U.S. Provisional Patent Application No. 60/931,846, filed May 24, 2007, the contents of which are incorporated herein by reference in their entirety.

BACKGROUND OF THE INVENTION

1. Field of the Invention

This invention resides in the field of thermoelectric devices and the heat sinks used in conjunction with these devices.

2. Description of the Prior Art

Thermoelectric devices are widely used for heating metal blocks that hold reaction receptacles in chemical and biochemical laboratories, particularly multiple tubes or multi-receptacle plates. The metal blocks often referred to as "sample blocks," and the typical sample block contains a planar array of depressions or wells with a separate sample receptacle in each well. Procedures that are commonly performed on samples in a sample block involve keeping each sample under close temperature control and heating and cooling the samples in discrete, programmed steps.

The polymerase chain reaction (PCR) is one of many examples of chemical processes that are performed on multiple samples and require precise temperature control with rapid temperature changes between different stages of the procedure. PCR amplifies DNA, i.e., it produces multiple copies of a DNA sequence from a single copy. PCR is typically performed in instruments that provide reagent transfer, temperature control, and optical detection in a multitude of reaction vessels such as microplates, tubes, or capillaries. The various stages of the procedure are temperature-sensitive, with different stages performed at different temperatures and maintained for designated periods of time, and the sequence is repeated in cycles. In a typical procedure, a sample is first heated to about 95° C. to "melt" (separate) double strands, then cooled to about 55° C. to anneal (hybridize) primers to the separated strands, and then reheated to about 72° C. to achieve primer extension through the use of the polymerase enzyme. This sequence is repeated to achieve multiples of the product DNA, and the time consumed by each cycle can vary from a fraction of a minute to two minutes, depending on the equipment, the scale of the reaction, and the degree of automation. Another example of a chemical process that involves temperature changes and a high degree of control is nucleic acid sequencing. Still further examples will be apparent to those knowledgeable in the fields of molecular biology and biochemistry in general.

The processes cited above are frequently performed on large numbers of samples, each of a relatively small volume, often on the microliter scale, using automated laboratory equipment. A central component of this equipment is the reaction module, which includes the sample block, a thermoelectric device or array of such devices contacting the underside of the sample block, and a heat sink associated with the thermoelectric device, all with appropriate thermal interfaces to achieve maximal heat conduction. One example of such a module is shown in Atwood, J. G., et al. U.S. Pat. No. 7,133,726 B1. The heat sink in Atwood et al. includes a "generally planar base 34" that contacts the thermoelectric devices directly and a series of fins 37 extending downward from the base. A "trench 44" is cut into the base 34 outside the perimeter of the thermoelectric device to limit heat conduction and to decrease edge losses from the area bounded by the trench (column 8, lines 9-13). The patent states that, heat loss at the corners of a rectangular sample block is greater than at other locations on the block, causing the corners to become cooler (column 5, lines 40-41). The patent recommends the placement of insulation around the corners to control this heat loss, and the use of a small thermal connection from the center of the sample block to the heat sink that acts as a "heat leak" to reduce the temperature in the center of the block and thereby maintain a more uniform temperature across the block (column 5, lines 44-54).

SUMMARY OF THE INVENTION

It has now been discovered that heat losses at the edges (including the corners) of the sample block in a reaction module can be reduced or eliminated by using a temperature control assembly that includes a thermoelectric device, or array of such devices, and a heat sink with specially placed voids. The term "thermoelectric means" is used herein to encompass both an individual thermoelectric device and an array of thermoelectric devices. The heat sink includes a heat-conductive slab (analogous to the "generally planar base 34" of Atwood et al.) and heat-dissipating fins, and the voids are in the slab at locations within or at the edge of the perimeter of the thermoelectric device or an array of such devices. Voids are included at locations that are directly underneath the portions of the sample block that would otherwise tend to be at reduced temperatures due to the arrangement of the thermoelectric devices or to the proximity of the locations to the edges of the sample block. The slab contains a higher concentration of voids, i.e., a greater void volume per unit area, in regions of the slab that surround a central region of the slab. In some cases, the central region of the slab is void-free, while in others, voids are present in the central region but are either fewer in number (i.e., resulting in less void volume) or more spaced apart than the voids outside the central region. The surprising discovery is that, despite the placement of these voids in the slab below the thermoelectric device(s), the voids are effective in causing the slab to heat the sample block uniformly by limiting the cooling of the thermoelectric device(s) at the locations above the voids. These and other features, embodiments, and advantages of the invention will be apparent from the description that follows.

DETAILED DESCRIPTION OF THE INVENTION AND PREFERRED EMBODIMENTS

Figure 1A:
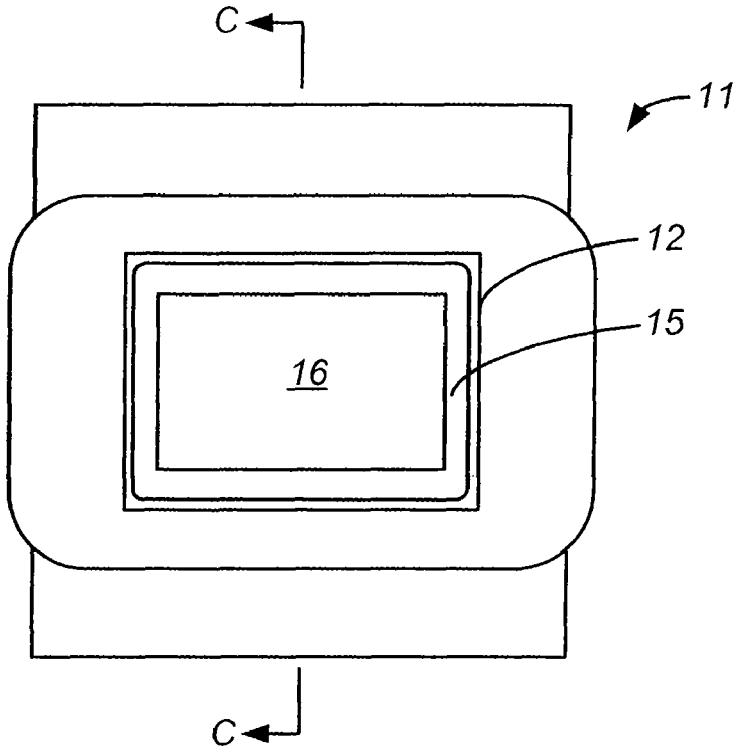
FIG. 1*a* is a top view of the heat sink portion of one example of a thermoelectric device/heat sink assembly in accordance with the present invention.

Thermoelectric devices, also known as Peltier devices or Peltier thermoelectric devices, are unitary electronic devices that utilize the well-known Peltier effect to cause heat flow in either of two opposing directions depending on the direction of an electric current through the device. A description of a typical thermoelectric device is found in Atwood et al. cited above. As noted above, the present invention is applicable to systems that contain but a single thermoelectric device as well as those that contain two or more. Each thermoelectric device is generally rectangular in shape, and when two or more thermoelectric devices are present, they are preferably arranged contiguously in a rectangular array, although in some cases, adjacent thermoelectric devices can be separated by a gap. When an array of thermoelectric devices is used, the array preferably consists of two to twenty thermoelectric devices, and in the most preferred embodiments, four to ten thermoelectric devices. The expression "thermoelectric means" is used herein to encompass both a single thermoelectric device and an array of thermoelectric devices. The thermoelectric device or array of such devices is arranged to form a flat area that is in contact with the sample block, and heat is actively transferred across this area between the sample block and the thermoelectric device(s). The sample block can either be coextensive with the flat area occupied by thermoelectric device(s) or can extend beyond it.

The term "voids" is used herein to denote areas in the heat-conductive slab that have been left open, i.e., that form discontinuities in the heat-conductive material and are generally filled with air. Although expressed in the plural, the term "voids" is used herein to include both a plurality of discrete unfilled areas as well as a single extended unfilled area such as a trench. The term "voids" further denotes depressions that extend only part way through the slab and are thus open only to one side of the slab, preferably the side facing the thermoelectric device(s), as well as holes that extend through the thickness of the slab and are open at both sides of the slab. When the voids consist of discrete depressions or holes, each such depression or hole preferably has a maximum width of from about 1% to about 15%, and more preferably from about 1% to about 5%, of the smallest lateral dimension of the area occupied by the thermoelectric device(s).

The "voids" can also be edge sections of the slab that are entirely removed. In these cases, the slab is not coextensive with the area occupied by the thermoelectric device(s), but instead terminates within that area, leaving the edges of the area occupied by the thermoelectric device(s) and strips adjacent to these edges fully exposed. In cases where the voids terminate inwardly of this area, the outermost edges of the voids are preferably a distance of from about 0.1 mm to about 20.0 mm, and most preferably from about 0.2 mm to about 3.0 mm, from the edge (i.e., the periphery) of the area occupied by the thermoelectric device(s). In other configurations that are also within the scope of this invention, the slab extends beyond the area occupied by the thermoelectric device(s), and the voids are either within the area occupied by the thermoelectric devices or they extend beyond the periphery of the area. When the voids extend beyond the periphery, the outer edges of at least some of the thermoelectric devices will traverse (cut across) one or more voids.

While the problems in obtaining uniform heating are most often encountered near the outer regions of the heat sink and hence the outer regions of the area occupied by the thermoelectric device(s), heating anomalies can also occur at sites toward the center of the area. This can occur, for example, when adjacent thermoelectric device(s) are separated by a small gap at or near the center of an array of the devices. To address such anomalies, the slab in accordance with this invention will contain voids at the sites of the anomalies, which will in general require fewer voids or smaller voids than those located closer to the edges. Thus, as noted above, these more centrally located voids will be of lower density, either in terms of spatial density or individual size, than those closer to the edges of the area occupied by the thermoelectric device(s).

The slab, and the heat sink as a whole, which includes both the slab and the heat-dissipating fins, can be of any heat-conductive material, and is preferably made of a metal or a metal alloy. Aluminum, copper, and stainless steel are examples; others will be readily apparent to those familiar with the manufacture and/or use of thermal cyclers. The slab is either integral with the fins or the slab and fins can be manufactured as separated pieces that are joined by welding or other conventional joining means to achieve a thermal interface, which means that the contact is of a nature that heat transfer across the interface is substantially unobstructed by the interface itself. The contact between the slab and the thermoelectric devices is also a thermal interface despite the use of dissimilar materials. To achieve a thermal interface between the slab and the thermoelectric devices, materials such as GRAFOIL® (UCAR Company, Inc., Wilmington, Del., USA) and various thermal greases that are readily available can be placed between these components.

While the features defining this invention are capable of implementation in a variety of constructions, the invention as a whole will be best understood by a detailed examination of specific embodiments. Several such embodiments are shown in the drawings.

Figure 1B:
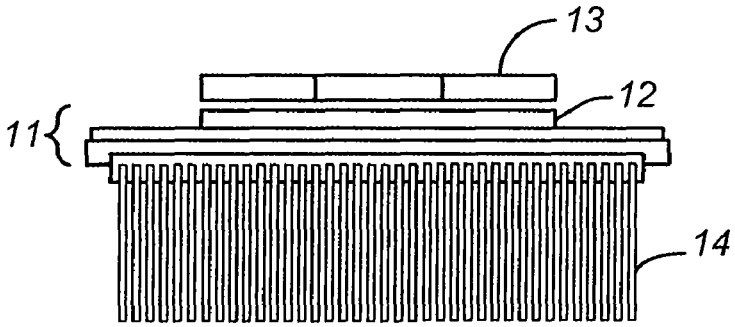
FIG. 1*b* is a front view of the same heat sink, plus an array of thermoelectric devices.
Figure 1C:
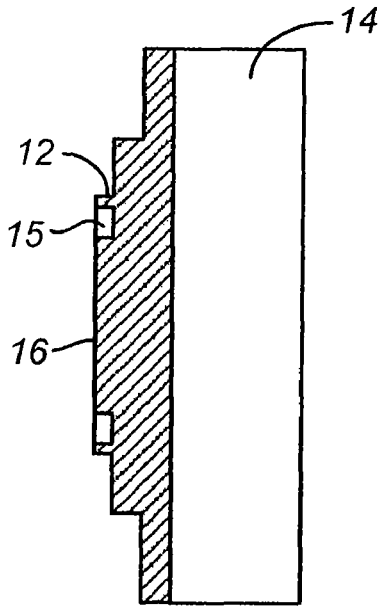
FIG. 1*c* is a cross section view taken along the line C-C of FIG. 1*a*.

FIGS. 1*a*, 1*b*, and 1*c* are three views, respectively, of one example of a temperature control assembly of the present invention. The top view of FIG. 1*a* shows the slab 11 of heat-conductive material with a raised area 12, or pedestal, in the center of the slab, the perimeter of the pedestal being of the same dimensions as the area occupied by the thermoelectric devices. The front view of FIG. 1*b* shows the raised area 12 of the slab in profile with an array of thermoelectric devices 13 above it, the thermoelectric devices themselves raised a short distance above the slab to emphasize that the flat area formed by the surfaces of the thermoelectric devices 13 is coextensive with the raised area 12 of the slab. In use, the thermoelectric devices 13 will be in direct contact with the raised area 12 of the slab. FIG. 1*b* also shows the heat-dissipating fins 14 that, together with the slab 11, constitute the heat sink.

Returning to FIG. 1*a*, the voids in this embodiment of the invention take the form of a single loop-shaped depression or trench 15. The trench 15, which is also visible in the cross section of FIG. 1*c*, surrounds a central area 16 of the slab, the central area in this case being void-free.

Figure 2A:
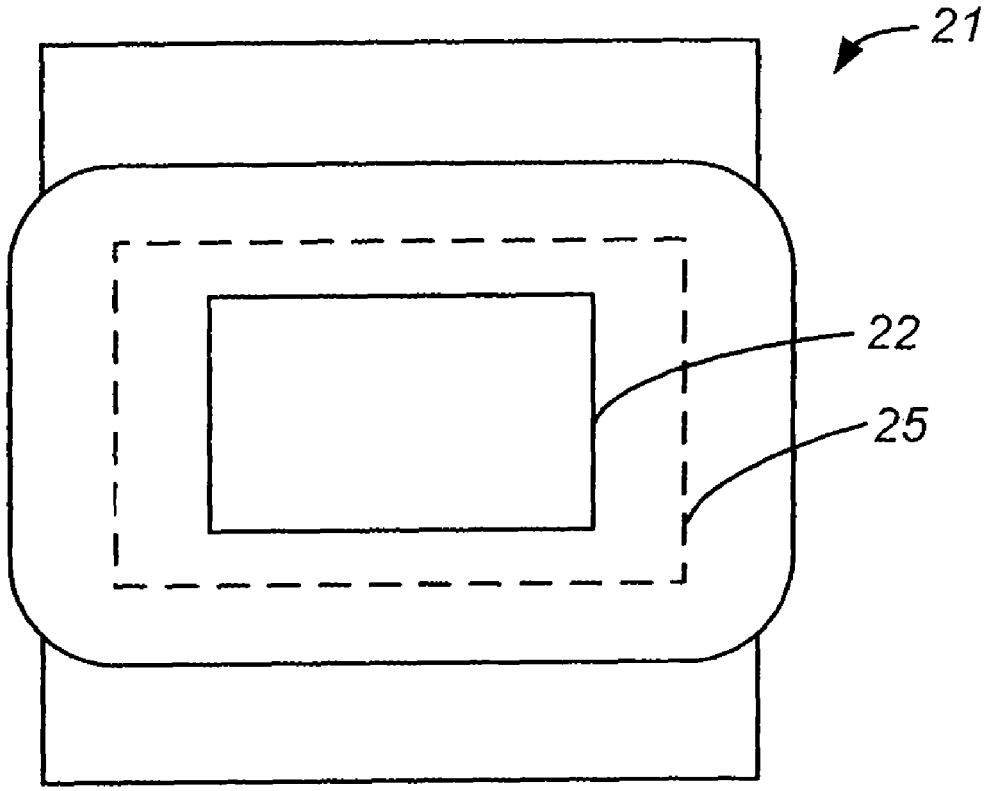
FIG. 2*a* is a top view of the heat sink portion of a second example of an assembly in accordance with this invention.
Figure 2B:
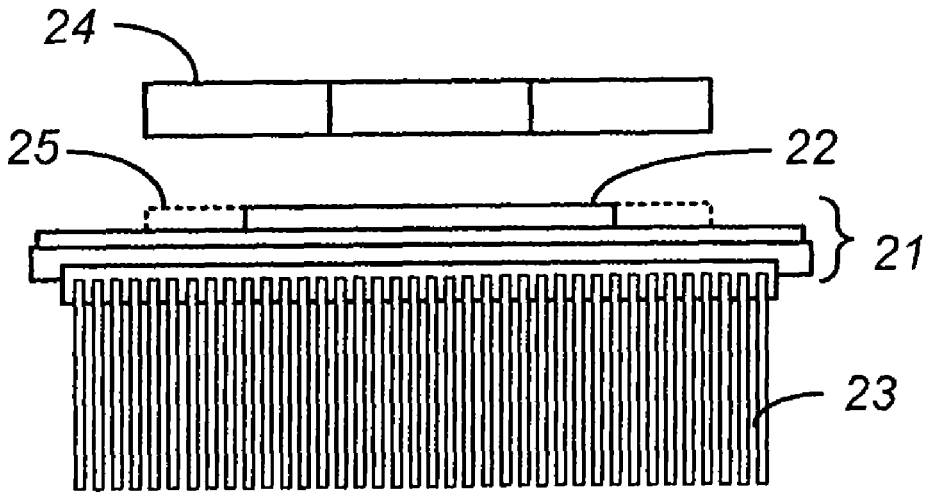
FIG. 2*b* is a front view of the same heat sink, plus an array of thermoelectric devices.

A second example is shown in FIGS. 2*a* and 2*b*. The slab 21 in this example likewise has a raised area 22, as shown in both the top view of FIG. 2*a* and the front view of FIG. 2*b*. As in the example of FIGS. 1*a*, 1*b*, and 1*c*, the slab 21 is coupled to heat-dissipating fins 23, as shown in FIG. 2*b* which also shows a thermoelectric device array 24 poised above the slab 21. Here as well, the thermoelectric devices 24 will be in direct contact with the raised area 22 of the slab when the apparatus is in use. The voids in this embodiment take the form of a peripheral area 25 that has been entirely removed from the slab and is represented by dashed lines in both FIGS. 2*a* and 2*b*. The raised area 22 of the slab that contacts the underside of the thermoelectric device array 24 is thus smaller both in length and width than the area occupied by the array 24.

Figure 3:
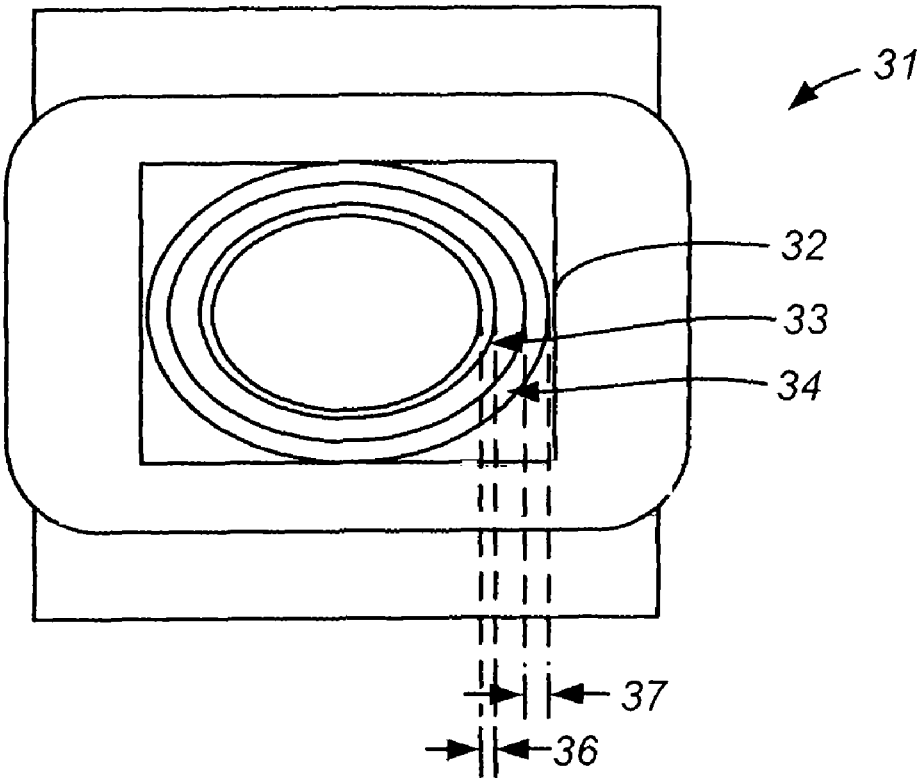
FIG. 3 is a top view of the heat sink portion of a third example of an assembly in accordance with this invention.

A variation of the loop-shaped trench of the example of FIGS. 1*a*, 1*b*, and 1*c* is illustrated in the example shown in FIG. 3. The slab 31 in this example has a raised area 32, similar to that of FIGS. 1*a*, 1*b*, and 1*c*, which is coextensive with the area occupied by the thermoelectric devices, although the thermoelectric devices are not shown in FIG. 3. This structure has two loop-shaped trenches 33, 34, which are concentric and oval in shape, together surrounding a void-free area 35 at the center of the slab. The widths 36, 37 of the ovals in this example are not equal; the width 37 of the outer oval 34, which is closest to the periphery of the slab, is greater than the width 36 of the inner oval 33. Greater prevention of heat loss is thereby achieved at locations closer to the periphery of the slab, where the slab is more vulnerable to heat loss. Variations of this arrangement are readily apparent, including ovals of equal width, or ovals surrounded by edge sections that are entirely removed.

Figure 4:
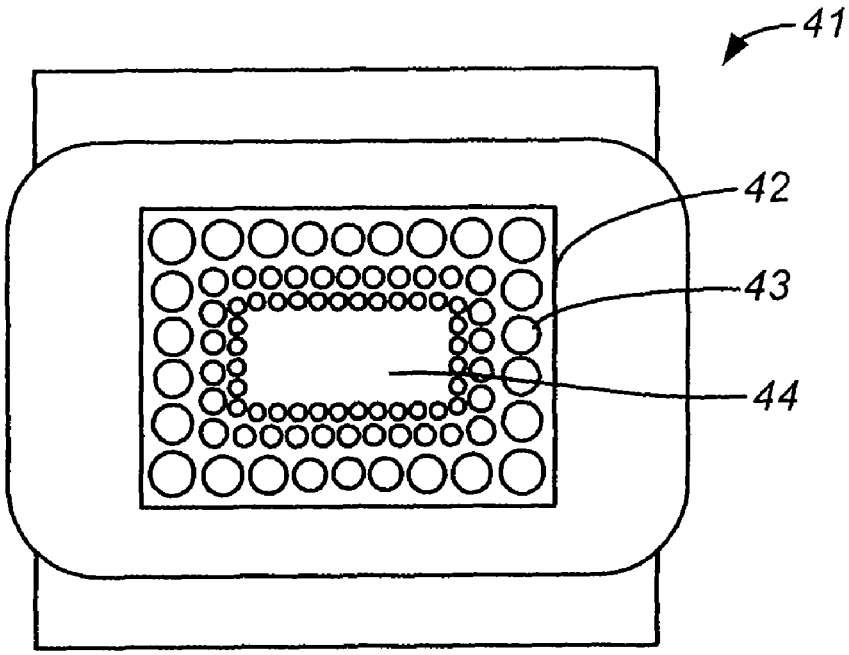
FIG. 4 is a top view of the heat sink portion of a fourth example of an assembly in accordance with this invention.

A fourth example is shown in FIG. 4. As in the examples of FIGS. 1*a*, 1*b*, 1*c*, and 3, the slab 41 of the example of FIG. 4 has a raised area 42 that is coextensive with the area occupied by the thermoelectric devices, although the thermoelectric devices are not shown. The voids in this example are a series of depressions or holes 43 distributed symmetrically around a central void-free area 44. The depressions or holes 43 are of graded diameters, increasing in size toward the periphery of the raised area 42 and also toward the corners of the raised area. This is another means of providing greater prevention of heat loss in regions where the slab is most susceptible to heat loss.

Figure 5A:
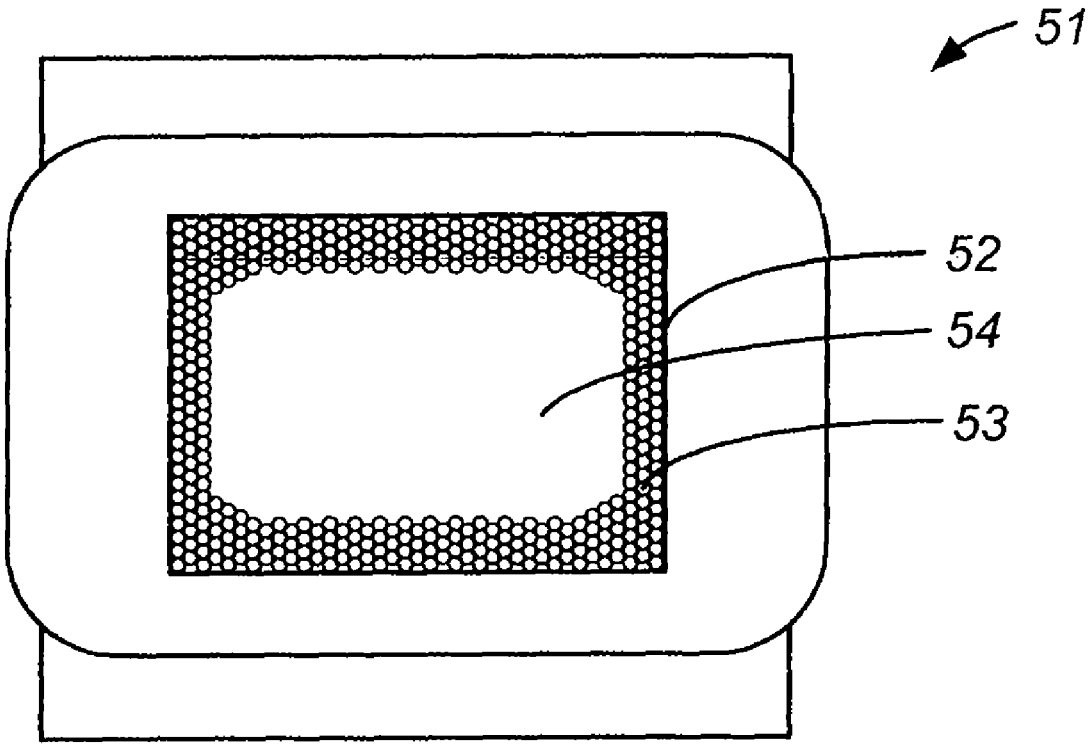
FIG. 5*a* is a top view of the heat sink portion of a fifth example of an assembly in accordance with this invention.
Figure 5B:
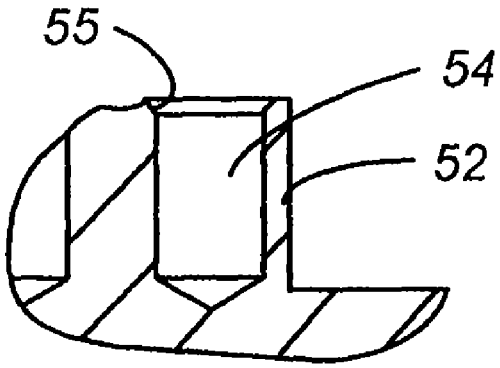
FIG. 5*b* is a cross section of the same heat sink.

FIGS. 5*a* and 5*b* illustrate a fifth example of a slab in accordance with the present invention. As in the examples of FIGS. 1*a*, 1*b*, 1*c*, 3, and 4, the slab 51 of the example of FIGS. 5*a* and 5*b* has a raised area 52 that is coextensive with the area occupied by the thermoelectric devices. The voids in this example are depressions of circular cross section 53, all of the same diameter, but again distributed symmetrically around a central area 54 that is void-free. The cross section of FIG. 5*b* shows that the voids 53 are indeed depressions rather than holes extending through the slab, and that the upper edges of the depressions, on the side of the slab facing the thermoelectric modules, are chamfered or beveled 55, which adds to the heat loss prevention effect.

While the foregoing description describes various alternatives, still further alternatives will be apparent to those who are skilled in the art and are within the scope of the invention.

In the claims appended hereto, the term "a" or "an" is intended to mean "one or more." The term "comprise" and variations thereof such as "comprises" and "comprising," when preceding the recitation of a step or an element, are intended to mean that the addition of further steps or elements is optional and not excluded. All patents, patent applications, and other published reference materials cited in this specification are hereby incorporated herein by reference in their entirety. Any discrepancy between any reference material cited herein and an explicit teaching of this specification is intended to be resolved in favor of the teaching in this specification. This includes any discrepancy between an art-understood definition of a word or phrase and a definition explicitly provided in this specification of the same word or phrase.

What is claimed is:

1. A temperature control assembly for a multi-receptacle sample block, said assembly comprising:

(a) thermoelectric means spanning a substantially flat area bounded by a perimeter; and (b) heat sink means comprising:

(i) heat-dissipating fins positioned at an underside of said thermoelectric means and extending throughout and optionally beyond said flat area, and (ii) a slab of heat-conductive material positioned between, and in contact with, said underside of said thermoelectric means and said heat-dissipating fins, to transmit heat between said thermoelectric means and said heat-dissipating fins by conduction, said slab containing voids distributed across said slab within said perimeter of said flat area with a higher void density in regions surrounding a central region of said slab.

2. The temperature control assembly of claim 1 wherein said voids comprise a loop-shaped depression in said slab surrounding said central region.

3. The temperature control assembly of claim 1 wherein said voids have outermost edges that are within a distance of about 0.1 mm to about 10.0 mm of said perimeter of said area spanned by said thermoelectric means.

4. The temperature control assembly of claim 1 wherein said voids have outermost edges that are within a distance of about 0.2 mm to about 3.0 mm of said perimeter of said area spanned by said thermoelectric means.

5. The temperature control assembly of claim 1 wherein said voids comprise a plurality of concentric loop-shaped depressions in said slab surrounding said central region, said plurality including an innermost loop-shaped depression and an outermost loop-shaped depression, said outermost loop-shaped depression having a width greater than that of said innermost loop-shaped depression.

6. The temperature control assembly of claim 1 wherein said voids comprise a plurality of discrete depressions each having a maximum width of from about 1% to about 15% of the smallest lateral dimension of said area spanned by said thermoelectric means.

7. The temperature control assembly of claim 6 wherein said depressions that are further from the center of said area spanned by said thermoelectric means are greater in width than said depressions that are closest to said center.

8. The temperature control assembly of claim 1 wherein said voids comprise a plurality of discrete depressions each having a maximum width of from about 1% to about 5% of the smallest lateral dimension of said area spanned by said thermoelectric means.

9. The temperature control assembly of claim 8 wherein all said depressions are circular in shape and of equal diameter.

10. The temperature control assembly of claim 1 wherein said voids have openings facing said thermoelectric means and said openings have beveled edges.

11. The temperature control assembly of claim 9 wherein said depressions have openings facing said thermoelectric means and said openings have beveled edges.

12. The temperature control assembly of claim 1 wherein said thermoelectric means comprises from two to twenty thermoelectric devices arranged in a rectangular array.

13. The temperature control assembly of claim 1 wherein said thermoelectric means comprises from four to ten thermoelectric devices arranged in a rectangular array.

* * * * *